US007020244B1

(12) United States Patent
Wilson et al.

(10) Patent No.: US 7,020,244 B1
(45) Date of Patent: Mar. 28, 2006

(54) METHOD AND DESIGN FOR ELECTRICAL STRESS MITIGATION IN HIGH VOLTAGE INSULATORS IN X-RAY TUBES

(75) Inventors: Colin Richard Wilson, Niskayuna, NY (US); Yang Cao, Niskayuna, NY (US); Richard Michael Roffers, Whitefish Bay, WI (US); Claire Alexandra Arnott, Franklin, WI (US); Ian Strider Hunt, Hubertus, WI (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 11/015,269

(22) Filed: Dec. 17, 2004

(51) Int. Cl.
*H01J 35/00* (2006.01)

(52) U.S. Cl. ..... 378/139; 378/142

(58) Field of Classification Search ..... 378/139, 378/119, 142, 136; 313/275, 27, 530, 333, 313/313, 632, 618
See application file for complete search history.

(56) References Cited

U.S. PATENT DOCUMENTS 3,911,306 A * 10/1975 Peter ..... 378/139
5,526,396 A * 6/1996 Jacob ..... 378/136
6,798,865 B1 9/2004 Tang ..... 378/119
6,816,574 B1 11/2004 Hansen ..... 378/121
6,901,136 B1 * 5/2005 Tekletsadik et al. ..... 378/119
2004/0096037 A1 5/2004 Tang et al. ..... 378/142
2004/0232834 A1 11/2004 Costello ..... 313/530

FOREIGN PATENT DOCUMENTS

WO WO 00/57449 9/2000

* cited by examiner

*Primary Examiner*—David V. Bruce
*Assistant Examiner*—Hoon Song
(74) *Attorney, Agent, or Firm*—Fletcher Yoder

(57) ABSTRACT

In accordance with one embodiment, the present technique provides an X-ray tube. The X-ray tube includes an anode assembly configured to emit X-ray beams and a cathode assembly configured to emit electrons towards the anode assembly. The cathode assembly includes an insulator and a cathode post. The insulator includes a side surface, wherein the side surface includes a recessed portion. The cathode post includes a hollow interior region having an interior surface, wherein the interior surface is configured to engage with the side surface of the insulator. The cathode post may also include a foot portion that extends away from the interior surface at the end of the cathode post. The cathode post adjacent to the recessed portion of the insulator is configured to shield a triple point to reduce electrical stresses on the triple point.

24 Claims, 6 Drawing Sheets

METHOD AND DESIGN FOR ELECTRICAL STRESS MITIGATION IN HIGH VOLTAGE INSULATORS IN X-RAY TUBES

BACKGROUND

The present invention relates generally to a system for managing electrical stresses in an X-ray tube for high voltage applications and, more specifically, to a cathode assembly with a high-voltage insulator that manages electrical stresses at its triple point.

X-ray systems are generally utilized in various applications for imaging in the medical and non-medical fields. For example, X-ray systems, such as radiographic systems, computed tomography (CT) systems, and tomosynthesis systems, are used to create internal images or views of a patient based on the attenuation of X-ray beams passing through the patient. Based on the X-ray beams, a profile of the patient is created. Alternatively, X-ray systems may also be utilized to in non-medical applications, such as detecting minute flaws in equipment or structures and/or scanning baggage at airports.

Typically, the X-ray system includes an X-ray tube that is utilized as the source of X-ray beams directed to a detector or film. The X-ray tube includes a cathode assembly and an anode assembly, which may be housed inside an evacuated tube. The cathode assembly includes a negative electrode and the anode assembly includes a positive electrode. The cathode assembly is typically heated to emit electrons, which travel across an open space, such as a vacuum, at very high speeds to collide with the positive electrode of the anode assembly, which produces the X-ray beams. As discussed above, these X-ray beams are utilized to generate the desired image.

The X-ray system may operate at high voltages and temperatures, which affect the life expectancy of the X-ray tube. For instance, a voltage of about 140 kilo-volts may be applied between the electrodes of the cathode assembly and anode assembly to facilitate emission and acceleration of electrons towards the anode. Further, the cathode assembly may include an insulator for electrical isolation and a cathode cup that focuses the electrons towards a particular location in the anode assembly. Each of these components, such as the insulator and the cathode cup may be operated at voltages of about 140 kilo-volts. Because of the high powers within the X-ray tube, some of the components within the X-ray tube may also be subjected to temperatures that exceed 200 degrees Celsius. As such, the temperatures and voltages involved with the operation of the X-ray tube may affect the life expectancy of the X-ray tube.

Because of the voltages and temperatures involved, various problems may occur that cause the X-ray tube to fail. The failures may include electrical stresses, such as high voltage instabilities, surface flashovers, and other insulating failures that reduce the life expectancy of the X-ray tube. That is, the insulator of the X-ray tube may fail because of the electrical stresses. As an example, the electrical stresses may cause a failure to initiate from a triple point or triple junction of the X-ray tubes. The triple point is a location where the material of the cathode, air (i.e. vacuum), and the material of the insulator join together. The electrical stresses from the high voltages and temperatures are severe at the triple point and can trigger flashovers that accelerate the aging of the insulator leading to its failure in the X-ray tube.

Thus, there exists a need for a new system for managing electrical stresses in X-ray tubes. In particular, there is a need for a new technique to overcome the electrical stresses at the triple point in X-ray tubes.

BRIEF DESCRIPTION

Briefly in accordance with one embodiment, the present technique provides an X-ray tube. The X-ray tube includes an anode assembly configured to emit X-ray beams and a cathode assembly configured to emit electrons towards the anode assembly. The cathode assembly includes an insulator and a cathode post. The insulator includes a side surface, wherein the side surface includes a recessed portion. The cathode post includes a hollow interior region and an interior surface, wherein the interior surface is configured to engage with the side surface of the insulator. The cathode post adjacent to the recessed portion of the insulator is configured to shield a triple point to reduce electrical stresses on the triple point.

In accordance with another aspect, the present technique provides a method of manufacturing an X-ray tube. The method of manufacturing the X-ray tube includes manufacturing a cathode assembly. The method of manufacturing the cathode assembly includes fabricating a cathode post having a hollow interior region with an interior surface and a peripheral foot that extends from the interior surface. The method of manufacturing the cathode assembly also includes fabricating an insulator having a top surface and a side surface with a radial recess. The radial recess of the side surface is configured to form a void between the interior surface of the cathode post and the insulator. The method of manufacturing the cathode assembly further includes coupling the side surface of the insulator into the hollow interior region of the cathode post.

DRAWINGS

These and other features, aspects, and advantages of the present invention will become better understood when the following detailed description is read with reference to the accompanying drawings in which like characters represent like parts throughout the drawings, wherein.

Figure 5:
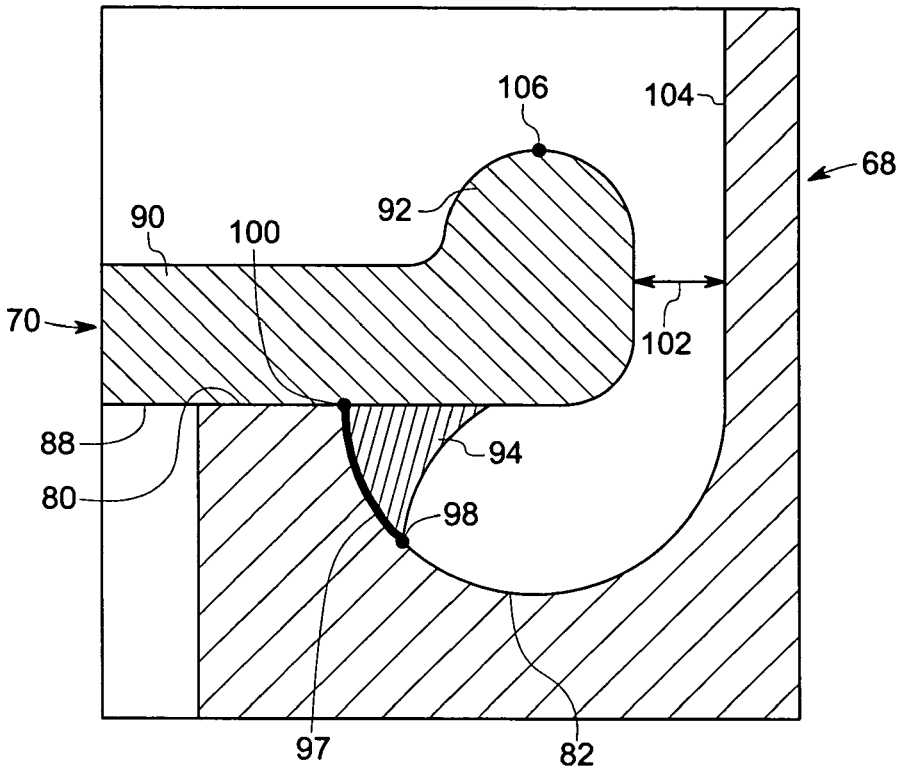
FIG. 5 is a partial cross-sectional view of insulator and cathode post of a cathode assembly with metallization, in accordance with an exemplary embodiment of present technique.
Figure 6:
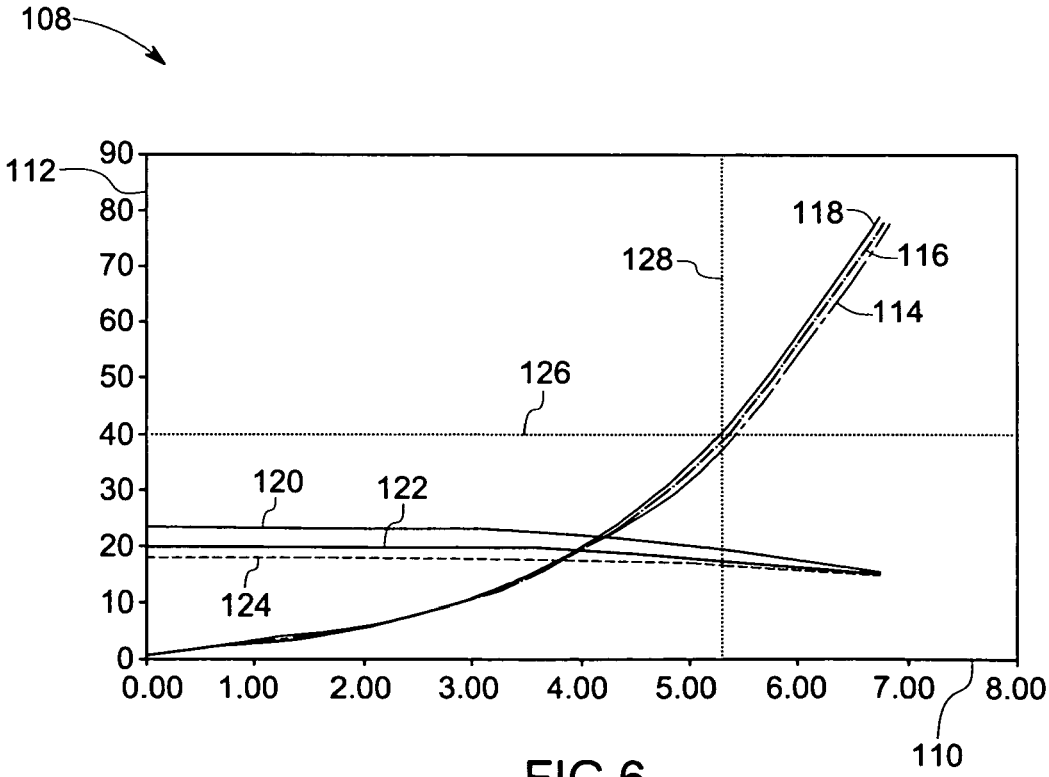
Figure 7:
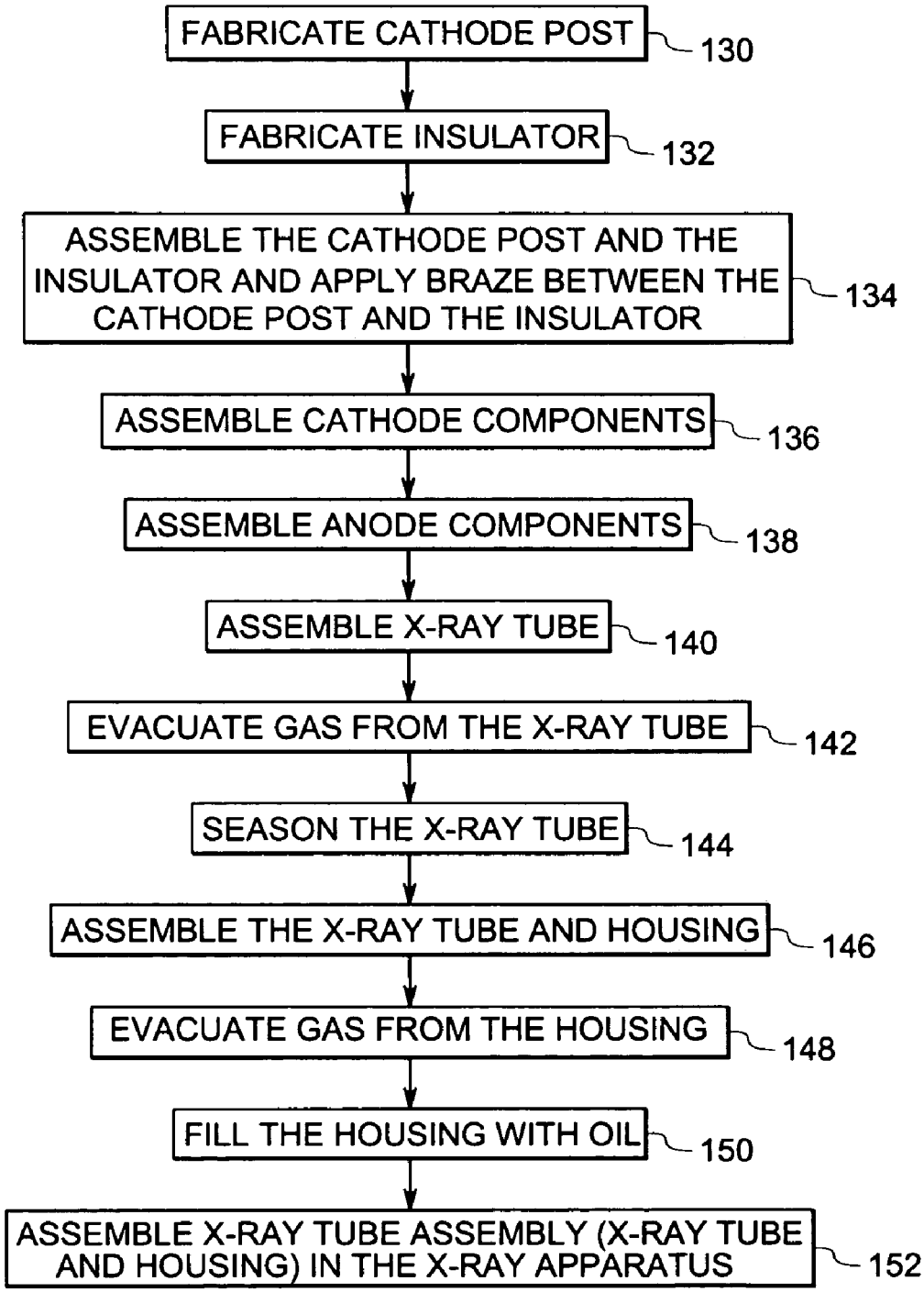

FIG. 6 graphically represents electrical stress verses a metallization length at the triple point shield of the cathode post and the insulator of FIG. 5 in accordance with certain aspects of present technique; and FIG. 7 is a flowchart illustrating an exemplary process for manufacturing an X-ray tube in accordance with aspects of present technique.

DETAILED DESCRIPTION

As a preliminary matter, the definition of the term "or" for the purpose of the following discussion and the appended claims is intended to be an inclusive "or." That is, the term "or" is not intended to differentiate between two mutually exclusive alternatives. Rather, the term "or" when employed as a conjunction between two elements is defined as including one element by itself, the other element itself, and combinations and permutations of the elements. For example, a discussion or recitation employing the terminology "A" or "B" includes: "A", by itself "B" by itself and any combination thereof, such as "AB" and/or "BA."

The present technique is generally directed towards managing electrical stresses in an X-ray tube for high voltage applications. As will be appreciated by those of ordinary skill in the art, the present techniques may be applied in various medical and non-medical applications. To facilitate the explanation of the present techniques, however, a medical implementation of an X-ray system will be discussed herein, though it is to be understood that non-medical implementations are also within the scope of the present techniques.

Figure 1:
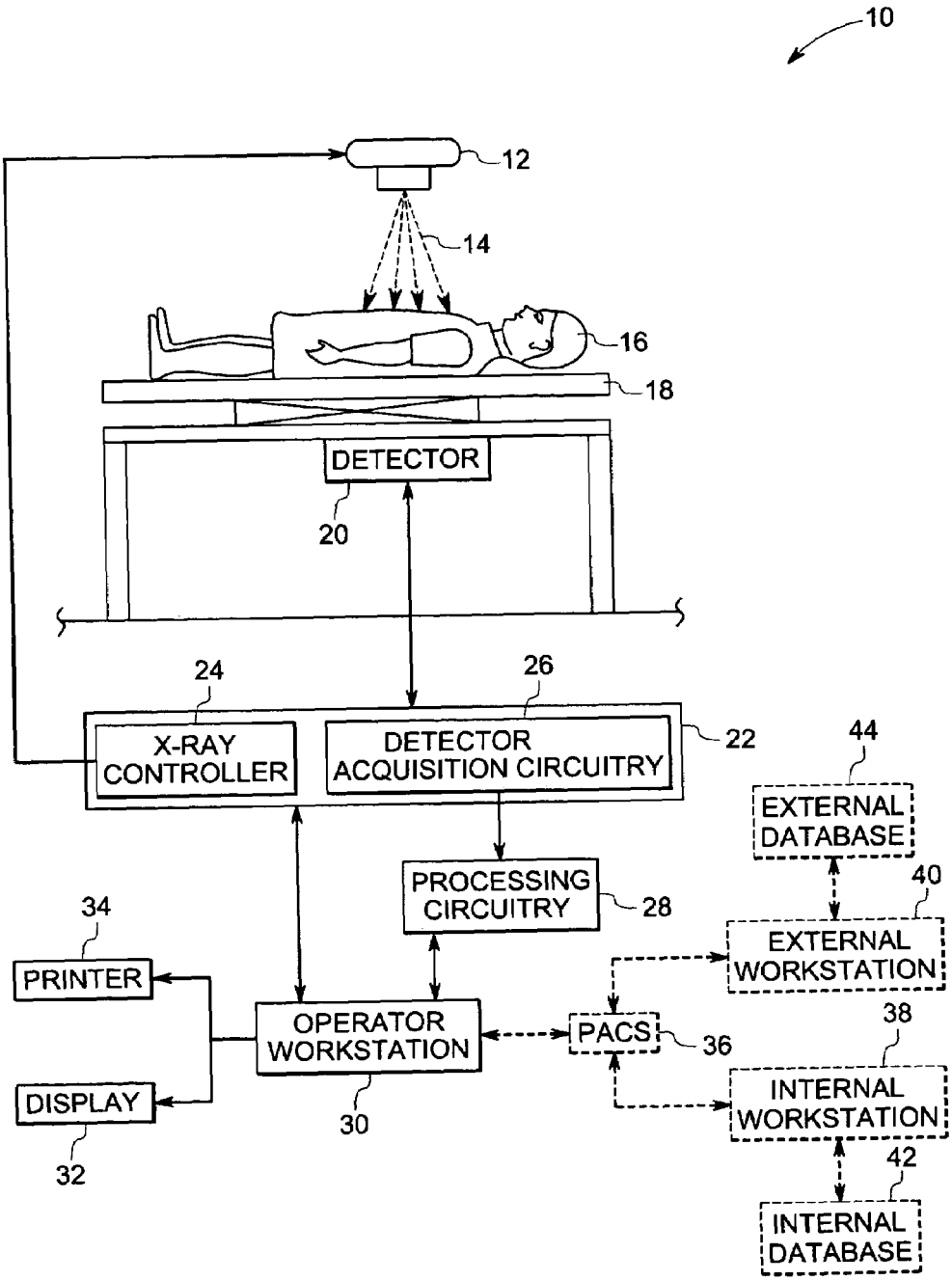
FIG. 1 is a diagrammatic representation of an X-ray imaging system in accordance with an exemplary embodiment of present technique.

Turning now to the drawings, FIG. 1 is an exemplary embodiment of an X-ray imaging system 10 for use in accordance with the present technique. As depicted, the X-ray imaging system 10 includes an X-ray source 12. The X-ray source 12 includes an X-ray tube within a housing and a collimator that directs X-ray beams 14 from the X-ray source 12 in a specific direction. The X-ray source 12 is configured to emit X-ray beams 14 toward a patient 16 situated within an imaging volume that encompasses a specific region of interest in the patient 16. The X-ray imaging system 10 further includes a patient positioning system 18, which may position the X-ray source relative to the patient 16 for imaging. The X-ray source 12 may be movable in one, two or three dimensions to different locations, either manually or by automated system, to change target the specific region of interest.

To detect the region of interest, the X-ray imaging system 10 also includes detection circuitry to detect the X-ray beams 14, such as an X-ray detector 20. The X-ray detector 20 is generally situated across the imaging volume from the X-ray source 12 and configured to detect X-ray beams 14. That is, the X-ray source 12, as described above, emits the X-ray beams 14 through the patient 16 towards the X-ray detector 20. The X-ray detector 20 receives these X-ray beams 14 and is configured either to generate an image in the X-ray film or to generate signals in response to the X-ray beams 14. While X-ray films are one possibility of detecting emitted X-ray beams 14, analog or digital detectors may also be employed to detect the emitted X-ray beams 14. Accordingly, the X-ray detector 20 may include a housing for X-ray films along with X-ray films or a digital or analog detector. Further, the X-ray detector 20 may be fixed into a stationary position or may be configured to move in coordination with or independent from the X-ray source 12.

In addition, other components may be utilized to interact with the X-ray detector 20. In one embodiment, the X-ray imaging system 10 may include a system controller 22 to control the operation of the X-ray source 12. In particular, the system controller 22 controls the activation and operation, including collimation and timing, of the X-ray source 12 via an X-ray controller 24. The system controller 22 may also control the operation and readout of the information from the X-ray detector 20 through detector acquisition circuitry 26. The detector acquisition circuitry 26 may provide digital signals in response to the X-ray beams 14 to other components, such as processing circuitry 28, to process the signals associated with the image.

The processing circuitry 28 is typically utilized to process and reconstruct the data from the detector acquisition circuitry 26 to generate one or more images for display. The processing circuitry 28 may include memory circuitry (not shown) to store the data before and after the processing of the data. The memory circuitry may also store processing parameters and/or computer programs that are utilized to process the signals associated with the images.

The processing circuitry 28 may be connected to other equipment, such as an operator workstation 30, a display 32, and a printer 34, to interact with an operator. For instance, the images generated by the processing circuitry 28 may be sent to the operator workstation 30 to be presented to an operator on the display 32. The processing circuitry 28 may also be configured to receive commands or processing parameters related to the processing or images or image data from the operator utilizing the operator workstation 30. The commands may be inputted via input devices, such as a keyboard, a mouse, and other user interaction devices (not shown), which are part of the operator workstation 30. The operator workstation 30 may also be connected to the system controller 22 to allow the operator to provide commands and scanning parameters related to the operation of the X-ray source 12 and/or the detector 20. Hence, an operator may control the operation of different parts of the X-ray imaging system 10 via the operator workstation 30.

In addition, the operator workstation 30 may also be connected to other systems and components. For instance, the operator workstation 30 may be coupled to a picture archiving and communication systems (PACS) 36. The PACS 36 may be utilized to archive the captured X-ray images and to communicate with external or internal databases through networks, as described further below. Accordingly, the operator workstation 30 may access images or data accessible via the PACS 36 for processing by the processing circuitry 28, for displaying on the display 32, or for printing on the printer 34. Also, the PACS 36 may be coupled to an internal workstation 38 and/or an external workstation 40 to provide access to the X-ray images from other locations. The internal workstation may be a computer that is coupled to an internal database 42 to store the X-ray images. Similarly, the external workstation 40 may be coupled to an external database 44. Thus, the PACS 36 via the workstations 38 and 40 may send and receive data to and from the databases 42 and 44.

Figure 2:
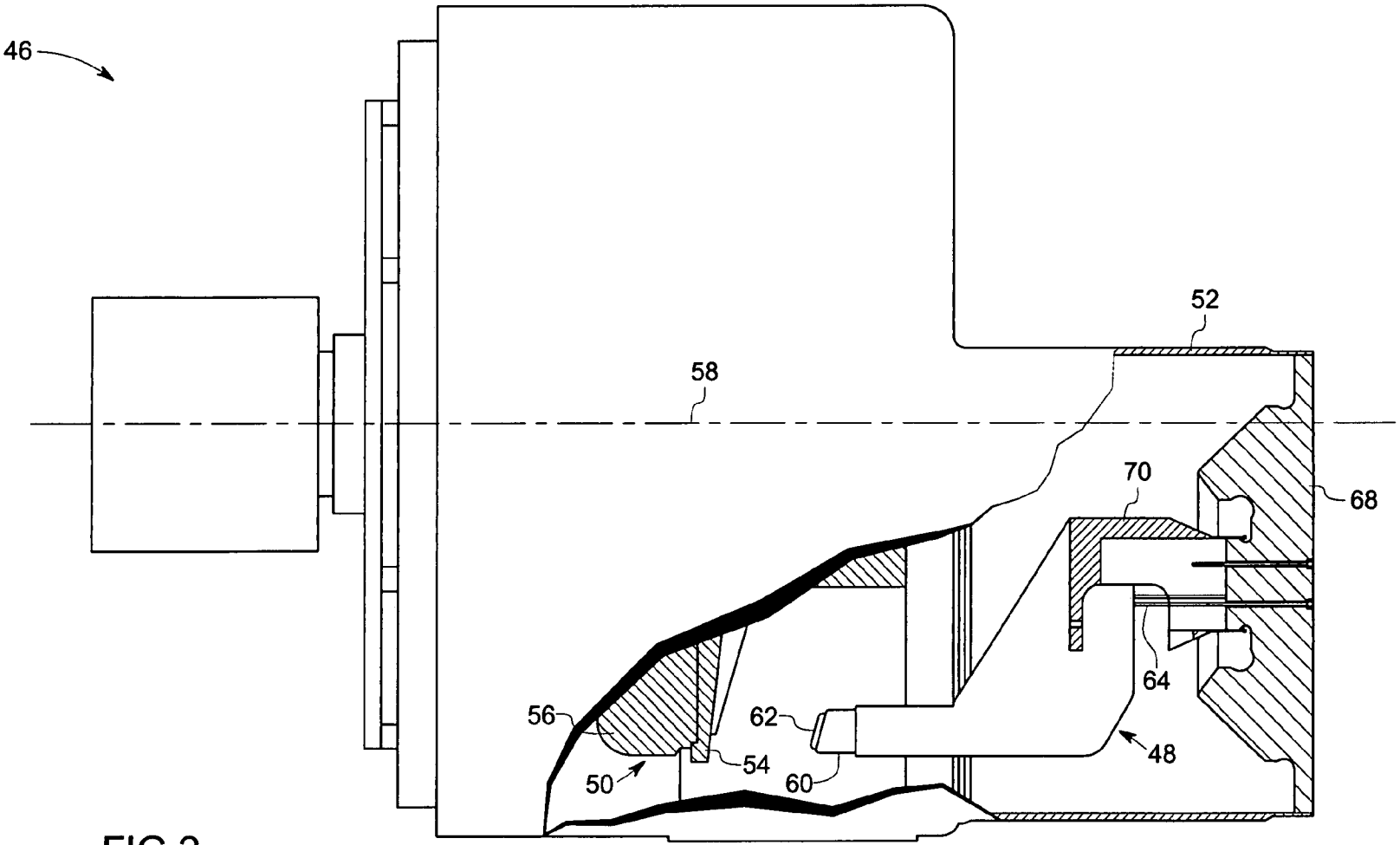
FIG. 2 is a partial cross-sectional view of an X-ray tube in accordance with an exemplary embodiment of present technique.

The X-ray source, as discussed above, uses an X-ray tube to generate the X-ray beams. FIG. 2 is a partial cross-sectional view of an X-ray tube 46, which may be utilized within the X-ray source 12 of FIG. 1 in accordance with an exemplary embodiment of present technique. The X-ray tube 46 includes a cathode assembly 48 and an anode assembly 50. The cathode assembly 48 and an anode assembly 50 are located within a housing or casing 52. This casing 52 may be made of glass or metallic material that is utilized to seal the various components of the X-ray tube 46. During operations, a voltage is applied across the electrodes of cathode assembly 48 and the anode assembly 50. This voltage facilitates the emission of electrons by the cathode assembly 48 towards the anode assembly 50. The collision of the emitted electrons with the anode in the anode assembly 50 produces the X-ray beams.

The anode assembly 50 generally includes different components that are utilized to produce X-rays. For instance, the anode assembly 50 may include an anode disk 54 and an anode backing 56 that are configured to rotate about a longitudinal axis 58 of the X-ray tube 46. The anode disk 54 may be constructed from tungsten alloy or other suitable material. The anode backing 56 and the rotation of the anode disk 54 facilitates improving thermal conditions of the anode disk 54, i.e. dissipating heat due to operations. The anode assembly 50 also includes other components, such as a stem (not shown) for supporting the anode disk 54 and a rotor with bearings (not shown) to facilitate rotation of the anode disk 54.

Generally, the cathode assembly 48 includes various components that are utilized to emit electrons towards the anode disk 54. For instance, the cathode assembly 48 includes a focusing cup 60 and one or more tungsten filaments 62. The tungsten filaments 62 are configured to emit electrons that are directed by the focusing cup 60 towards the anode assembly 50. Further, the cathode assembly 48 includes one or more pins 64, which are utilized to apply a voltage to the tungsten filaments 62 through one or more cables (not shown). In particular, the pins 64 via the cables facilitate the application of a high voltage to the tungsten filaments 62. Finally, the cathode assembly 48 may include an insulator 68 and a cathode post 70. The cathode post 70 facilitates mounting of cathode structures and the cathode filaments 62.

Figure 3:
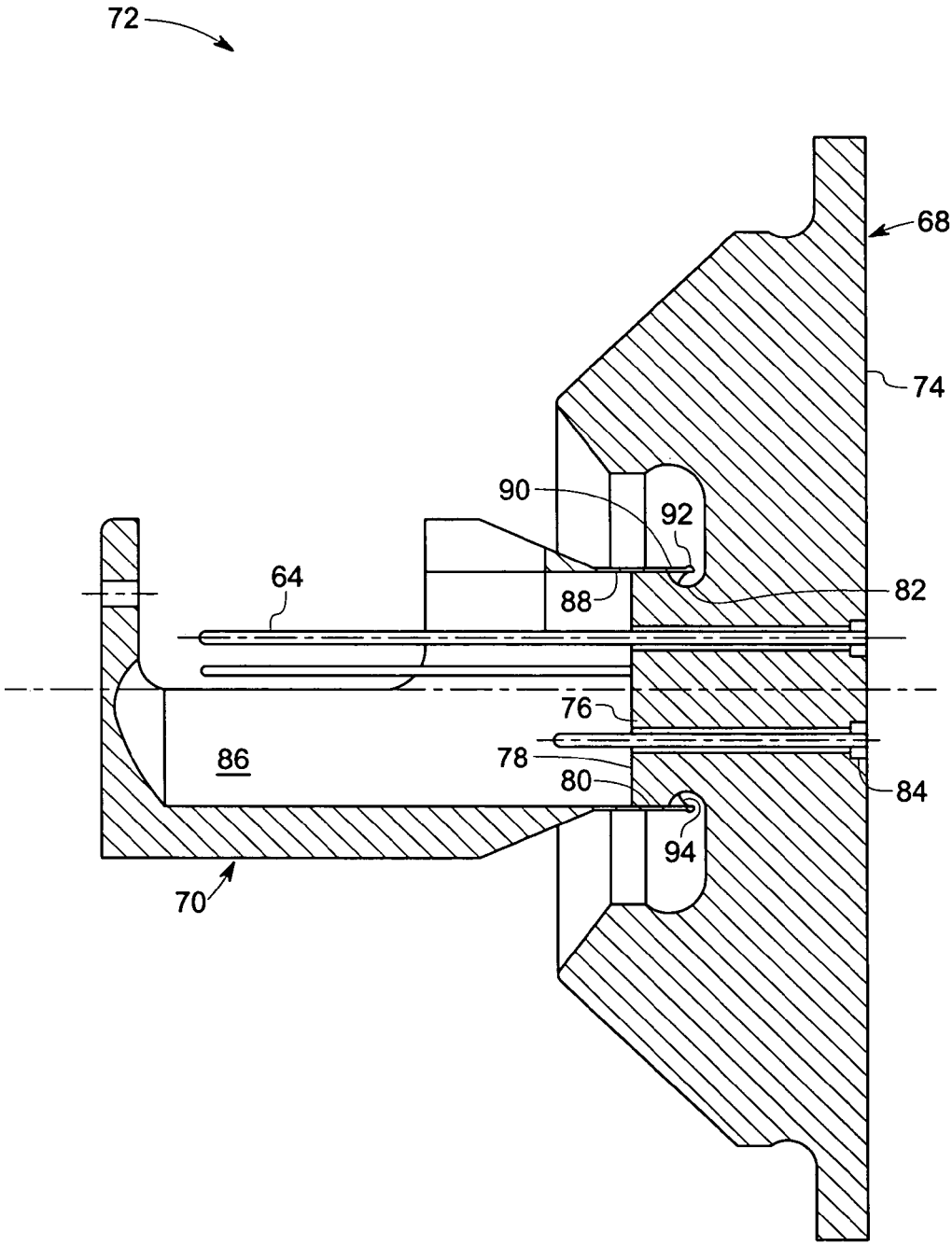
FIG. 3 is a cross-sectional view of an assembly of the cathode and the insulator of FIG. 2.

As discussed above, during operation, the triple point or triple junction, where the cathode post 70, the insulator 68 and the vacuum meet in a cathode assembly 48 is subjected to high electrical stress. This electrical stress may lead to failure of the X-ray tube 46. FIG. 3 is a cross-sectional view of an exemplary embodiment of a partial assembly 72 of the cathode post 70 and the insulator 68 of FIG. 2 in accordance with an embodiment of the present technique. In particular, the insulator 68 may include a recessed portion 82 and the cathode post 70 may include a triple point shield 90 along with a peripheral foot 92 that are utilized to reduce the stresses on the triple point.

The insulator 68 may include various aspects and structures that are utilized to provide support for the cathode post 70 and the pins 64. The insulator 68 is made of electrically insulated material, such as ceramic. The insulator 68 includes a base portion 74 and an extension 76 at the center of the insulator 68 that may be utilized to engage with the cathode post 70, as discussed below. The extension 76 of the insulator 68 includes a top surface 78, a side surface 80 and the recessed portion 82 adjacent to the side surface 80. The side surface 80 of the insulator 68 is configured to engage with the cathode post 70, as discussed further below. The shape of a cross-section of the extension 76 may be a circle, a polygon, and/or others similar shapes that are configured to engage with the cathode post 70. The insulator 68 further includes a plurality of holes 84 that provide access for the pins 64. As described above, the pins 64 facilitate the application of a voltage to the tungsten filament.

The cathode post 70 may be utilized to provide support to the cathode cup and the filaments, as discussed above. The cathode post 70 may be fabricated of nickel-iron alloy or American Society for Testing and Materials (ASTM) F15 alloy, or other suitable conductive material, capable withstanding high temperatures with low thermal expansion. The cathode post 70 includes a hollow interior or internal region 86 that is formed within the interior surface 88 of the cathode post 70. Further, the cathode post 70 includes the triple point shield 90, which is formed at the end of the cathode post 70. The triple point shield 90 facilitates shielding the triple point thereby reducing the electrical stresses at the triple point, as discussed further below. The cross-section of the hollow interior region 86 may be a circle, a polygon, or other shapes that are suitable to engage with and be brazed to the extension 76 of the insulator 68. Further, the cathode post 70 includes a peripheral foot 92 at the end of the cathode post 70. The peripheral foot 92 may be utilized to improve the stiffness of the triple point shield 90 of the cathode post 70 and to reduce electrical stress at the base of the cathode post 70. The cross-section of the peripheral foot 92 may be a semi-circle, a polygon, or other suitable shape.

To couple the insulator 68 and the cathode post 70 together, a braze material 94 may be utilized. The braze material 94 is applied between triple point shield 90 of the cathode post 70 and the insulator 68 above the recessed portion of the insulator 68, i.e., in region 80. The braze material 94 may include silver, silver-copper alloy or gold-copper alloy.

Figure 4:
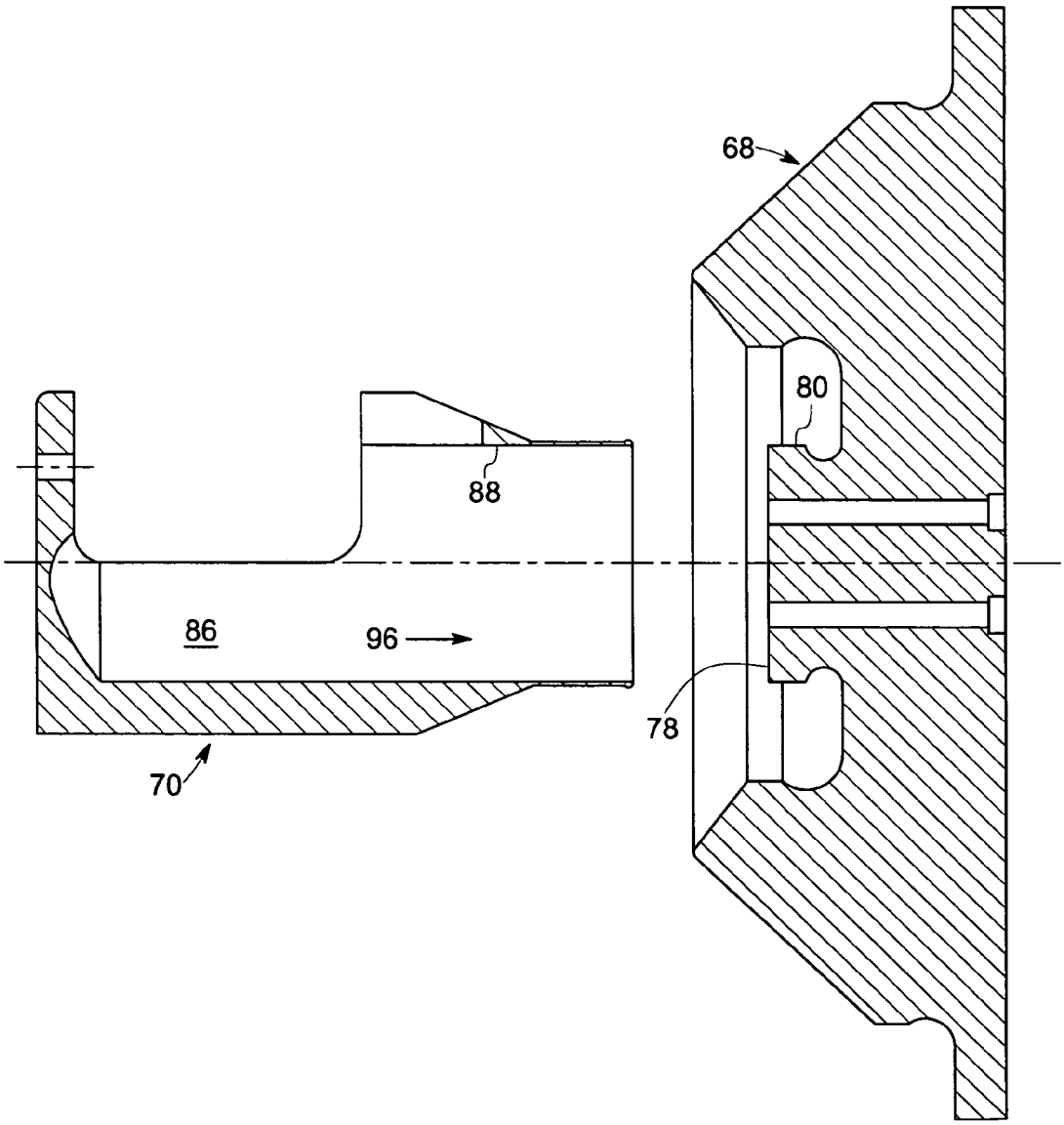
FIG. 4 is an exploded cross-sectional view of the cathode and the insulator of FIG. 3.

FIG. 4 is an exploded cross-sectional view of the partial assembly 72 of FIG. 3. In this embodiment, the cathode post 70 engages with the insulator 68 by moving in a direction indicated by the arrow 96. Specifically, the interior surface 88 of the cathode post 70 engages the side surface 80 of the insulator 68. The cross-section of the hollow interior region 86 of the cathode post 70 and that of the extension 78 of the insulator 68 are so selected that they facilitate coupling of the cathode post 70 with the insulator 68.

FIG. 5 is a partial cross-sectional view of the insulator 68 and the cathode post 70 of the cathode assembly with metallization in accordance with an exemplary embodiment of present technique. In the present embodiment, the cathode post 70 and the insulator 68 are assembled such that the interior surface 88 of the cathode post 70 is adjacent to the side surface 80 of the insulator 68. As will be appreciated by those skilled in the art, a braze joint is formed between the interior surface 88 of the cathode post 70 and the side surface 80 of the insulator 68. However, some braze material 94 may overflow and a metal layer or metallization 97 may form over the segment of the recessed portion 82 of the non-metallic insulator 68. The braze overflow may result from variations in the brazing process, as described above. Hence, the surface of the recessed portion 82 may also be referred to as a metal overflow region. Thus, the recessed portion 82, the triple point shield 90 and the peripheral foot 92 facilitate reducing the effect of braze overflow on the triple point and hence reduces the electrical stress.

Due to metallization 97, the triple point is positioned at a point denoted by the reference numeral 98. In other words, the braze overflow 94, the recessed surface 82 of the insulator 68 and the air or vacuum meet at the point 98 instead of a point denoted by reference numeral 100. Hence in the absence of the braze material 94, the triple point may be positioned at the point 100 at which the triple point shield 90 of the cathode post 70, the insulator side surface 80 and air or vacuum meet. As will be appreciated by those skilled in the art, the triple point 98 may be exposed to high electrical stresses, which may cause field emission or surface flashovers. As discussed above, the triple point shield 90 shields the triple point 98 and hence may reduce the electrical stresses at the triple point 98.

Further, the cathode post 70 and the insulator 68 are coupled together to form a gap 102. The gap 102 may be a distance of at least 1 mm between the peripheral foot 92 of the cathode post 70 and the lower surface 104 of the insulator 68. If the gap 102 is not maintained (i.e., the peripheral foot 92 of the cathode post 70 touches the surface 104 of the insulator 68), then a triple point will be formed at a location where the peripheral foot 92 touches the insulator 68, reducing the benefit of the shield 90. A point 106 on an outer surface of the peripheral foot 92 denotes a point in the vacuum and the electrical stress at the point 106 is discussed further below.

The technical practices for dealing with high voltage vacuum insulation are discussed by R. V. Latham in High Voltage Vacuum Insulation—The Physical Basis, page 52, Academic Press (1981). Accordingly, the total electrical field at the triple point 98 is given by the equation:

$$\text{Total electrical field strength at triple point} = \beta \text{Emacro} \quad (1)$$

Where

β is field enhancement factor; and

Emacro is the electrical field strength at the triple point in kv/mm.

It is also observed that field emissions occur when the total field strength at the triple point 98 (βEmacro), exceeds 3000 kv/mm. Hence, considering the field enhancement factor (β) to be 75 and solving for the field strength at the triple point (Emacro), based on the equation (1) above, the field strength (Emacro) may not exceed 40 kv/mm to avoid field emissions. The method of maintaining the field strength (Emacro) at the triple point 98 below 40 kv/mm is discussed further below in FIG. 6.

FIG. 6 is a graphical representation 108 of electrical stress verses the length of metallization and variation in a gap 102 between the triple point shield 90 (i.e. peripheral foot 92) of the cathode post 70 and the insulator 68, in accordance with certain aspects of present technique. The X-axis 110 represents length of metallization in mm (millimeter) between the points 100 and 98. The Y-axis 112 represents the electrical field strength in kv/mm (kilo-volt per millimeter) at the triple point 98 and the point 106 in the vacuum. As described above, in the present embodiment, the length of the gap 102 between the peripheral foot 92 and the surface 104 of the insulator 68 is about 1 mm to 1.5 mm. Curves 114, 116 and 118 represent the field strength at the triple point 98 versus metallization length with variations in the gap 102 of −0.5 mm, 0 mm and +0.5 mm respectively. Similarly curves 120, 122 and 124 represent the field strength at the vacuum point 106 versus metallization length with variations in the gap 102 of −0.5 mm, 0 mm and +0.5 mm respectively.

Because it is beneficial for the field strength at the triple point 98 may not exceed 40 kv/mm to avoid field emissions, the influence of the metallization and gap length may be adjusted to maintain a specific filed strength. Referring back to the graph 108, the horizontal line 126 represents field strength of 40 kv/mm, which intersects the curves 114, 116 and 118 near the vertical line 128, which denotes a metallization length of 5.5 mm. A variation of the length of the gap 102 between −0.5 mm and +0.5 mm has no substantial effect on the field strength. However, variations of the metallization length have a significant effect on the field strength. Thus, by limiting the metallization length to about 5.5 mm, the field strength can be maintained at around 40 kv/mm at the triple point 98 to avoid field emissions.

FIG. 7 is a flowchart illustrating exemplary process blocks for manufacturing an X-ray tube, such as X-ray tube 46 in accordance with aspects of present technique. FIG. 7 may be best understood when concurrently viewing FIGS. 2, 3 and 5. The process includes fabricating the cathode post 70, which includes machining the hollow interior region 86, the interior surface 88 and the peripheral foot 92, as in block 130. The process includes fabricating the insulator 68, which includes machining the top surface 78, the side surface 80 with the recessed portion 82, and applying a metal layer over the side surface 80, as in block 132. Then, the cathode post 70 and the insulator 68 may be assembled and a braze material 94 is applied between the cathode post 70 and the insulator 68, as shown in block 134. Then, at block 136, other cathode components are assembled to the cathode post 70 and the insulator 68.

Similarly, the anode components, including the anode disk 54 are assembled to finish the anode assembly 50 at block 138. The cathode assembly 48 and the anode assembly 50 are then coupled together with the casing 52 to form the X-ray tube 46, as shown in block 140. Once formed, the air or gas inside the X-ray tube 46 is evacuated or degassed, as shown in block 142. At block 144, the X-ray tube 46 is seasoned, which may include applying a voltage in steps until reaching the predetermined voltage. The X-ray tube 46 is then assembled to a housing, as shown in block 146. The gas or air inside the housing is then evacuated or degassed, as shown in block 148. Once the air is evacuated, the housing may be filled with oil, as shown in block 150. The oil may be utilized to cool the X-ray tube 46. Finally, the X-ray tube is assembled to an X-ray imaging apparatus, as shown in block 152.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. An X-ray tube comprising:

an anode assembly configured to emit X-ray beams; and a cathode assembly configured to emit electrons towards the anode assembly, wherein the cathode assembly comprises:

an insulator comprising a top surface and a side surface, wherein the side surface comprises a recessed portion; and a cathode post comprising a hollow interior region, an interior surface, and a peripheral foot, wherein the interior surface is configured to engage with the side surface of the insulator, and the peripheral foot is configured to extend beyond the side surface of the insulator and into the recessed portion.

2. The X-ray tube of claim 1, wherein the interior surface of the cathode post adjacent to the recessed portion of the insulator is configured to shield a triple junction.

3. The X-ray tube of claim 1, wherein the peripheral foot of the cathode post extends away from the interior surface at the end of the cathode post.

4. The X-ray tube of claim 3, wherein the peripheral foot comprises a semi-circular shape or a polygon shape cross-section.

5. The X-ray tube of claim 1, wherein the top surface of the insulator comprises a circular shape or a polygon shape cross-section.

6. The X-ray tube of claim 1, wherein the cathode post of the cathode assembly comprises nickel-iron alloy.

7. The X-ray tube of claim 1, wherein the insulator of the cathode assembly comprises a ceramic material.

8. The X-ray tube of claim 1, wherein the cathode post and the insulator of the cathode assembly are coupled by a braze material that is applied between the side surface of the insulator and the interior surface of the cathode post.

9. An X-ray imaging system comprising:

an X-ray tube configured to emit X-ray beams and having a cathode assembly, the cathode assembly comprises:

an insulator having a top surface and a side surface, wherein the side surface comprises a recessed portion; and a cathode post comprising a interior region having an interior surface, and a peripheral foot, wherein the interior surface is configured to engage with the side surface of the insulator and the peripheral foot is configured to extend beyond the side surface of the insulator and into the recessed portion; and an X-ray detector configured to receive the X-ray beams and generate a plurality of images based on the emitted X-ray beams.

10. The X-ray imaging system of claim 9, wherein the cathode post and the insulator are coupled by brazing.

11. The X-ray imaging system of claim 9, wherein the cathode assembly and an anode assembly are disposed within a tube.

12. The X-ray imaging system of claim 11, wherein the tube comprises a glass or metallic material.

13. The X-ray imaging system of claim 9, wherein the X-ray detector is configured to generate a plurality of signals in response to the X-ray beams emitted by the X-ray tube.

14. A method of manufacturing an X-ray tube, the method comprising:

manufacturing a cathode assembly, comprising:

fabricating a cathode post comprising a hollow interior region with an interior surface and a peripheral foot that extends from the interior surface;

fabricating an insulator having a top surface, a side surface and a radial recess on the side surface, wherein the radial recess is configured to form a void between the interior surface of the insulator; and coupling the side surface of the insulator into the hollow interior region of the cathode post such that a foot of the cathode extends into the recessed portion and beyond the side surface.

15. The method of claim 14, comprising applying a braze between the interior surface of the cathode post and the insulator proximate to the radial recess in the insulator.

16. The method of claim 14, comprising evacuating gases from the cathode post and the insulator.

17. The method of claim 14, comprising coupling the cathode assembly and an anode assembly into an X-ray tube housing.

18. The method of claim 17, comprising evacuating gases from the X-ray tube housing to remove gases inside the X-ray tube housing.

19. The method of claim 17, comprises seasoning the cathode assembly and the anode assembly by applying a high voltage to the cathode assembly and the anode assembly.

20. An X-ray tube comprising:

an anode assembly configured to emit X-ray beams; and a cathode assembly configured to emit electrons towards the anode assembly, the cathode assembly comprises an insulator partially inserted into a cathode post, wherein the insulator has a recessed portion into which a peripheral foot of the cathode post extends to form a triple point shield with the cathode post.

21. The X-ray tube of claim 20, wherein the triple point shield reduces electrical stress on a triple point.

22. The X-ray tube of claim 20, wherein the peripheral foot extends away from the recessed portion at an end of the cathode post.

23. The X-ray tube of claim 22, wherein the peripheral foot comprises a semi-circular shape or a polygon shape cross-section.

24. The X-ray tube of claim 20, wherein the recessed portion of the insulator comprises a semi-circular shape or a polygon shape cross-section.

* * * * *